United States Patent [19]

Corbett

[11] 4,081,236

[45] Mar. 28, 1978

[54] KILNS

[75] Inventor: James Trail Sinclair Corbett, Duffield, England

[73] Assignee: Butterley Building Materials Limited, Great Britain

[21] Appl. No.: 686,477

[22] Filed: May 14, 1976

[30] Foreign Application Priority Data

May 23, 1975 United Kingdom ..... 22948/75

[51] Int. Cl.[2] ..... F27D 1/16; F27D 1/08

[52] U.S. Cl. ..... 432/3; 432/251; 264/34; 110/331; 52/741

[58] Field of Search ..... 432/3, 76, 247, 248, 432/249, 251, 252; 110/99 R, 1 R, 99 A, 1 C; 52/741, 747; 264/30, 31, 32, 34

[56] References Cited

U.S. PATENT DOCUMENTS

| | | | |
|---|---|---|---|
| 1,837,146 | 12/1931 | Brooks | 432/247 |
| 2,011,701 | 8/1935 | Anderson | 110/99 R |
| 2,398,622 | 4/1946 | Crncich | 110/99 A |
| 2,517,876 | 8/1950 | Heuer | 110/99 A |
| 3,204,939 | 4/1965 | Ipsen | 432/251 |
| 3,474,581 | 10/1969 | Gery | 264/34 |
| 3,891,732 | 6/1975 | Hurst | 264/34 |

OTHER PUBLICATIONS

Industrial Furnaces, 5th Edition, by Trinks, pp. 288–289.

*Primary Examiner*—John J. Camby
*Assistant Examiner*—Henry C. Yuen
*Attorney, Agent, or Firm*—Miller & Prestia

[57] ABSTRACT

A kiln roof which is formed of a plurality of concrete panels slightly spaced to allow for expansion, each panel being suspended by suspension devices having anchors embedded in the panel, the roof being produced by casting in situ a refractory concrete and producing the separate panels by means of partitioning or inducing cracking.

4 Claims, 4 Drawing Figures

KILNS

This invention is concerned with kilns, for example, for firing bricks, the term "kiln" being used in this specification to include ovens and furnaces for other purposes.

Suspended roofs for kilns are known, but are liable to failure of the suspension system.

The present invention provides a roof of improved reliability and a method of constructing same.

In accordance with this invention, a method of construction a kiln roof comprises providing a roof framework, providing shuttering below the frame work, casting in situ a refractory concrete to form a concrete layer below the framework, hanging suspension devices from the framework and embedding anchors of the suspension devices in the concrete layer before setting of the latter, allowing the concrete to set, and removing the shuttering. The suspension devices may be positioned hanging from the framework before pouring of the concrete. Each suspension device may comprise one or more separate hook members having hook engagement with the metal anchor and with the framework.

Preferably, cracks are induced in the concrete layer to divide the cast concrete into a plurality of panels. This feature allows for thermal movement.

Advantageously, a loose insulating material such as unbonded granular expanded clay refractory material is laid on the top faces of the concrete panels to provide extra insulation.

The invention also resides in a kiln roof comprising a framework having suspension devices dependent therefrom, and concrete panels suspended by the devices, the latter having anchors embedded in the panels.

It is preferred that the framework consists of girders having cross-beams laid thereon (conveniently on lower flanges of I-section girders), the cross-beams being unconnected to the main girders. It is also preferred that the suspension members are free to move with respect to the framework. Both of these features allow for thermal movement.

Reference will now be made to the accompanying drawings, wherein.

Figure 1:
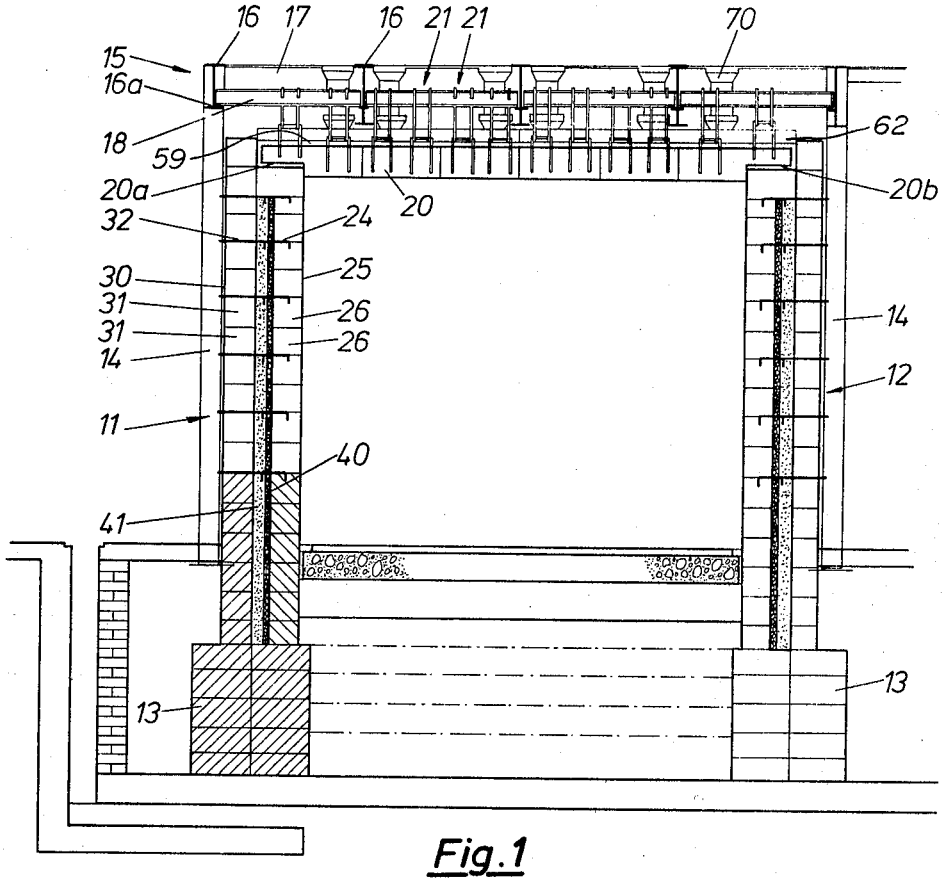
FIG. 1 is a sectional view of a kiln according to the invention.

Referring to FIG. 1, the kiln shown is of rectangular construction and two opposite, composite side walls 11, 12 are shown in the figure, supported on a foundation 13. The side walls are more fully described in the specification of our U.K. co-pending application Ser. No. 22947/75. Each composite side wall comprises an inner wall 25 constructed of refractory blocks 26, an outer wall 30 spaced around the inner wall and constructed of blocks 31, an intermediate wall 40 of calcium silicate, mineral fibre, or ceramic fibre, and a no-fines expanded clay concrete infill 41. The inner and outer walls are tied to stanchions 14 by tie-bars 32 bolted to the stanchions and having hook-and-eye engagement with anchoring members 24 engaged with the blocks of the inner wall.

The kiln has a roof 15, which is supported by the stanchions 14, in turn supported by the foundation 13. The roof is, therefore, supported independently of the walls 11, 12. The roof comprises a framework made up of girders 16, 17 and supported on the stanchions 14. Cross-beams 18 extend between the girders and are loosely laid on lower flanges, such as **16*a*, of the girders, which are of I-section. A concrete ceiling 20 is suspended from the cross-beams by suspension devices 21. The ceiling is made up of panels which are cast in situ from refractory concrete as described hereafter. The edges of the ceiling are formed with rebates 20*a*, 20*b* which receive and are sealed to the composite side walls, 11, 12** respectively to resist inward collapse thereof.

Figure 2:
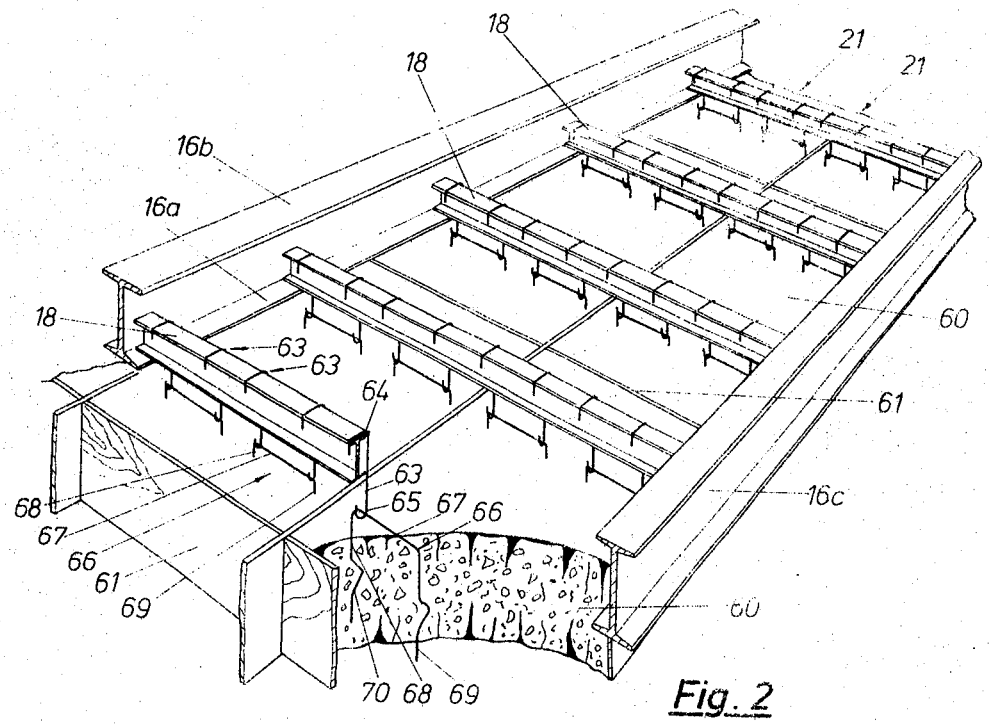
FIG. 2 is a perspective view on an enlarged scale of a portion of the roof of the kiln of FIG. 1.

FIG. 2 shows two girders **16*b*, 16*c* of the framework bridged by several of the cross-beams 18, which seat on lower flanges 16*a* of the two girders. Two pairs of suspension devices 21 are suspended from each beam to support the ceiling 20 and each pair of suspension devices on two adjacent beams supports a corresponding panel 60 of the ceiling, the panels being separated by partitioning 61, which allows for thermal movement and seals against escape of gases. Tiles 62** (FIG. 1) are bedded over all of the joints between the panels to facilitate sealing.

Each suspension device 21 comprises a pair of suspension hooks 63 each having an upper hook portion 64, adapted to hook over a cross-beam 18, and a lower hook portion 65, which supports an anchor member 66. Each anchor member 66 comprises an anchor bar 67 and a pair of legs 68, 69, the member being of inverted U-shape. Each leg 68, 69 has a cranked portion 70' which is embedded in the corresponding concrete panel 60 to support the latter.

An even insulating layer 59 of unbonded expanded clay or mineral wool is laid on the ceiling 20. This facilitates access to the ceiling. The layer does not cover the anchor bar 67 so that the latter can dissipate heat.

To construct the concrete ceiling 20, shuttering (not shown) is arranged beneath the framework of girders 16, 17 for casting the ceiling in sections. Each section may be constituted by the portion lying between the two girders **16*a*, 16*b*, for example. The shuttering for each section is divided into rectangular compartments by the partitioning 61 which is made of hardboard or similar material. Refractory concrete incorporating expanded clay aggregate is poured in situ and before setting, the partitioning 61 and the anchor members 66 are embedded in the concrete and the cross-beams 18 and suspension hooks 63 are positioned as shown in FIG. 2. After the concrete has set, the shuttering is removed leaving the panels 60 suspended by the suspension devices 21**.

In one example, each panel is approximately 2 feet square and 10 inches thick and ⅛ inch thick hardboard is used for the partitioning. The cross-beams and suspension hooks are made of mild steel and the anchor members of stainless steel, which in this case is EN58B.

Figure 3:
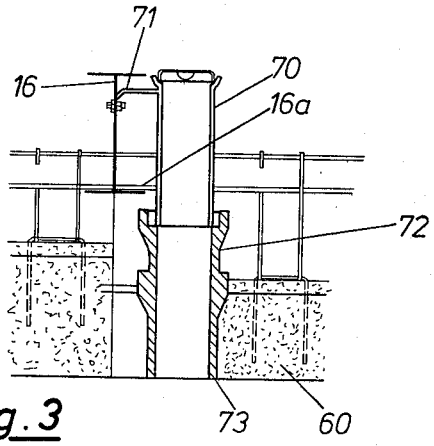
FIG. 3 is an enlarged sectional view of another portion of the roof.

Firing pots are set in the roof and for effecting heating of the kiln. One such pot 70, in this case of metal, is shown in FIG. 3. The pot is bolted to one of the girders 16 by means of a bracket 71 which also seats on a lower flange **16*a* of the bracket. The metal pot seats in a refractory pot 72, which, in turn, seats in a refractory lining 73 in a slab 60. The pots incorporate heaters in conventional manner. The linings 73 are positioned before pouring of the concrete for forming the slabs 60**.

The whole pot assembly may be made of the same refractory material as the roof.

Figure 4:
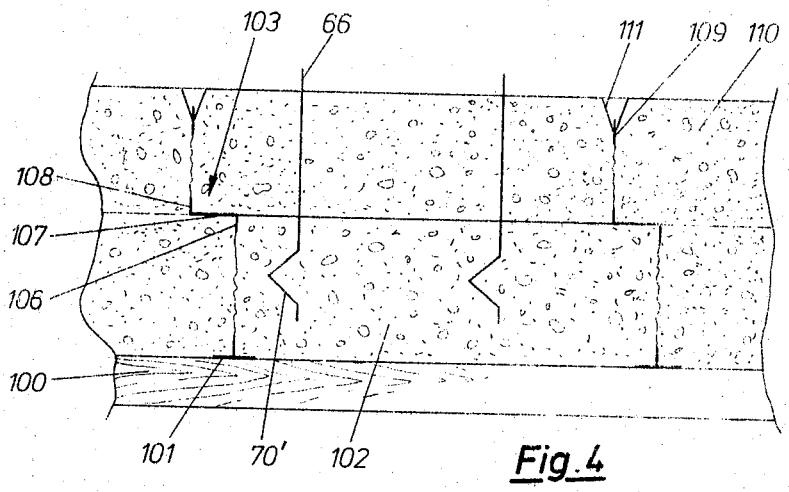
FIG. 4 is a sectional view of a portion of a modified kiln roof according to the invention.

Referring now to FIG. 4, shuttering 100 is arranged, as previously for casting the roof in situ, but, in this case, no partitions are provided. Instead, the shuttering is provided with lower crack inducers 101 of inverted T-section and elongate form, these inducers following generally the same pattern as the partitions shown in FIG. 2. A first layer of concrete 102 is poured onto the shuttering and the lower crack inducers 101 and envelops the cranked portions 70' of the anchor members 66. This layer is then allowed partially to set. Whilst this layer is setting, intermediate crack inducers 103 are arranged in the top of the first layer. These intermediate crack inducers are also elongate and are of cranked formation, each inducer having a downward projection 106, which is embedded in the first layer 102, these downward projections being aligned with the lower crack inducers, in co-planar relationship. Each intermediate crack inducer 103 has a central support portion 107, which is perpendicular to the downward projection 106, and which lies on the top of the first layer 102. Each intermediate crack inducer also has an upward projection 108, offset and parallel to the lower projection 106.

After arranging the intermediate crack inducers, a second layer 110 of concrete is poured on top of the first layer, so as to bond therewith and elongate top crack inducers 109 are embedded in the top of the second layer directly above and co-planar with the upward projections 108.

When the upper layer of concrete has set, parts of the top crack inducers 109 are removed and the gaps filled with a fibrous sealing material 111, for example, asbestos or ceramic fibre packing. Loose insulating material (not shown) may then be laid on top of the second concrete layer, as described with respect to FIGS. 1 to 3.

On heating of the kiln, the crack inducers burn out and the composite concrete layer 102, 110, cracks into panels, each crack, such as 113, having a double-right-angle bend at the original position of the intermediate crack inducer. This bend serves to provide a seal between the panels.

What we claim is:

1. A method of constructing a kiln roof comprising the steps of providing a roof framework, providing shuttering below the framework, casting in situ a refractory concrete to form a concrete layer below the framework, hanging suspension devices from the framework and embedding anchors of the suspension devices in the concrete layer before setting of the latter, providing crack inducing members in the concrete layer before setting of the latter, allowing the concrete to set, removing the shuttering, and firing the kiln so that the crack inducing members form a plurality of sealed thermal expansion cracks that divide the layer into a plurality of panels.

2. A method according to claim 1 further including, casting two concrete layers, one on top of the other, and inserting crack inducer members between the layers to induce cracks in the upper layer connected with and offset from cracks in the lower layer, the offset portion between layers defining a seal.

3. A method according to claim 1 further including providing additional sealing material in the cracks between the panels.

4. A method according to claim 1 wherein the step of providing crack inducers includes the step of placing burnable partitioning on the shuttering to divide the shuttering into a plurality of compartments whereby the partitioning is partially burnt out on firing of the kiln so that the remaining partitioning portions provide a seal.

* * * * *